US007515132B2

(12) United States Patent
Kim et al.

(10) Patent No.: US 7,515,132 B2
(45) Date of Patent: Apr. 7, 2009

(54) ANALOG BUFFER AND LIQUID CRYSTAL DISPLAY APPARATUS USING THE SAME AND DRIVING METHOD THEREOF

(75) Inventors: Kee-Jong Kim, Seoul (KR); Juhn-Suk Yoo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 734 days.

(21) Appl. No.: 10/879,162

(22) Filed: Jun. 30, 2004

(65) Prior Publication Data

US 2005/0140625 A1 Jun. 30, 2005

(30) Foreign Application Priority Data

Dec. 30, 2003 (KR) ..... 10-2003-0100654

(51) Int. Cl.
*G09G 3/36* (2006.01)

(52) U.S. Cl. ..... 345/98; 341/144

(58) Field of Classification Search ..... 345/98–100, 345/87, 204; 341/144, 145, 150, 126
See application file for complete search history.

(56) References Cited

U.S. PATENT DOCUMENTS 5,561,442 A * 10/1996 Okada et al. ..... 345/94
5,642,126 A * 6/1997 Okada et al. ..... 345/94
6,498,596 B1 * 12/2002 Nakamura et al. ..... 345/98
2003/0006979 A1 * 1/2003 Tsuchi et al. ..... 345/204

* cited by examiner

*Primary Examiner*—Amr Awad
*Assistant Examiner*—Stephen G Sherman
(74) *Attorney, Agent, or Firm*—McKenna Long & Aldridge LLP

(57) ABSTRACT

The present invention provides an analog buffer and a liquid crystal display apparatus using the same and a driving method thereof capable of reducing power consumption. An analog buffer according to the present invention includes: a comparator including an inverter connected in series to the input line; a feedback switch connected between the input line and the output line; and an output inverter, connected between the comparator and the output line, for pre-charging any one of driving voltages of a first driving voltage and a second driving voltage into the output line for a reset interval, and for cutting-off the first and second driving voltages when the pre-charged voltage is fed back via the feedback switch to the input line so that it is converged to the input voltage for a feedback interval.

8 Claims, 12 Drawing Sheets

ANALOG BUFFER AND LIQUID CRYSTAL DISPLAY APPARATUS USING THE SAME AND DRIVING METHOD THEREOF

This application claims the benefit of Korean Patent Application No. P2003-100654 filed in Korea on Dec. 30, 2003, which is hereby incorporated by reference for all purposes as if fully set forth herein.

BACKGROUND OF THE INVENTION

1. Field of the Invention

The present invention relates to an analog buffer, and more particularly, to an analog buffer and a liquid crystal display apparatus using the same and a driving method thereof capable of reducing power consumption.

2. Discussion of the Related Art

A liquid crystal display device displays a picture by way of controlling a light transmittance of liquid crystal materials having a dielectric anisotropy using an electric field. To this end, the liquid crystal display device includes a liquid crystal panel having a pixel matrix and a drive circuit for driving the liquid crystal panel.

As illustrated in FIG. 1, the liquid crystal display device of the related art includes a liquid crystal panel 2*r* having a pixel matrix, a gate driver 4*r* for driving gate lines GL1 to GLn of the liquid crystal panel 2*r*, a data driver 6*r* for driving data lines DL1 to DLm of the liquid crystal panel 2*r* and a timing controller 8*r* for controlling a driving timing of the gate driver 4*r* and the data driver 6*r*.

The liquid crystal panel 2*r* includes the pixel matrix having pixels 12*r* formed at each area defined by each intersection of gate lines GL and data lines DL. Each of the pixels 12*r* has a liquid crystal cell Clc that controls a light transmittance depending on the electric field generated by a pixel signal and a thin film transistor TFT that drives the liquid crystal cell Clc.

When the thin film transistor TFT receives a gate driving signal from a gate line GL, i.e., a gate high voltage VGH, the thin film transistor TFT is turned on to supply a video signal from the data line DL to the liquid crystal cell Clc. Moreover, when the thin film transistor TFT receives a gate low voltage VGL from the gate line GL, the thin film transistor TFT is turned off, thereby maintaining a video signal charged to the liquid crystal cell Clc.

The liquid crystal cell Clc can be equivalently represented as a capacitor. The liquid crystal cell Clc includes a common electrode and a pixel electrode connected to the TFT wherein a liquid crystal material is inserted between the common electrode and the pixel electrode. The liquid crystal cell Clc further includes a storage capacitor (not illustrated) for stably maintaining the video signal charged thereto until a next video signal is charged. The liquid crystal cell Clc varies the arrangement of liquid crystal materials with a dielectric anisotropy in accordance with the video signal charged through the TFT, thereby controlling the light transmittance. Accordingly, the liquid crystal cell Clc represents gray levels.

The liquid crystal panel 2*r* is driven by an inversion system in which a polarity of the liquid crystal cell Clc is inverted in a designated unit by a certain unit using a data signal, to prevent a deterioration of the liquid crystal materials and to improve display quality. The inversion system uses a frame inversion in which a polarity of a liquid crystal cell is inverted by units of one frame, a line inversion in which a polarity of a liquid crystal cell is inverted in units of horizontal lines, a column inversion in which a polarity of a liquid crystal cell is inverted in units of vertical lines, and a dot inversion in which a polarity of a liquid crystal cell is inverted in units of liquid crystal cells.

Among these inversion systems, the line inversion system has reduced power consumption compared to the column inversion and the dot inversion systems. It is because the column inversion and the dot inversion systems invert a polarity of a liquid crystal cell by using only a data signal, and thus a range of their driving voltages is relatively large, whereas, because the line inversion system alternates a common voltage Vcom supplied as a reference voltage, the range of a driving voltage can be lowered.

The gate driver 4*r* shifts a gate start pulse (GSP) from a timing controller 8*r* in accordance with a gate shift clock (GSC) to sequentially supply a scan pulse of the gate high voltage VGH to the gate lines GL1 to GLm. Moreover, the gate driver 4*r* supplies the gate low voltage VGL during a scan pulse of the gate high voltage VGH is not supplied to the gate lines GL1 to GLm.

The data driver 6*r* shifts a source start pulse (SSP) from the timing controller 8*r* in accordance with a source shift clock (SSC) to generate a sampling signal. Further, the data driver 6*r* latches a video data RGB provided by the signal SSC in accordance with the sampling signal, and then supplies the latched video data by a line unit in response to a source output enable (SOE) signal. Then, the data driver 6*r* converts digital video data RGB supplied by the line unit to analog video signals using gamma voltages, supplied from a gamma voltage, to thereby supply the analog video signals to the data lines DL1 to DLm. At this time, the data driver 6*r* determines the polarity of the video signals, in response to the polarity controlling signal (POL) from the timing controller 8*r* at the time of the conversion of the digital video data to the analog video signals.

The timing controller 8*r* generates the signals GSP and GSC for controlling the gate driver 4*r*, and also generates a source start signal SSP, a source shift clock SSC, a source output enable signal SOE and the signal POL signals for controlling the data driver 6*r*. More specifically, the timing controller 8*r* generates a variety of control signals such as the GSP, GSC, GOE, SSP, SSC, SOE, POL and the like by using a data enable DE signal representing an effective data interval, a horizontal synchronizing signal Hsync, a vertical synchronizing signal Vsync and a dot clock (DCLK) to determine the transmission timing of the pixel data RGB.

In the liquid crystal display device configured as described above, the data driver 6*r* includes an analog buffer for preventing a distortion of the video signal supplied to the data line, in accordance with an amount of RC load on the data line. The gate driver 4*r* also includes an analog buffer for preventing a distortion of the gate driving signal supplied to the gate line, in accordance with an amount of RC load on the gate line. In general, an amplifier (OP-AMP) is mainly used for the analog buffer. However, a scheme having a simplified circuit configuration using an inverter has been recently proposed.

For instance, a paper "AMLCD '02", pp. 21-24, published by Toshiba describes an analog buffer, which employs three inverters as illustrated in FIG. 2. The analog buffer illustrated in FIG. 2 includes: first to third inverters 3, 5 and 7 which are connected in series between an input line and an output line; first to third capacitors 2, 4 and 6 which are connected in series to input terminals of the first to the third inverter 3, 5 and 7, respectively; a first switch 1 connected between the input line and the first capacitor 2; second to fourth switches 8, 9 and 10 which are connected between input terminals and output terminals of the first to the third inverters 3, 5 and 7, respectively; and a fifth switch 11 connected between the input line and the output line.

First, for a reset interval RESET supplied by a first control signal CS1 as illustrated in FIG. 3, first to fourth switches 1, 8, 9 and 10 are turned on. Accordingly, an input terminal and an output terminal of the first to the third inverters 3, 5 and 7, respectively, are shorted, so that the first to third inverters 3, 5 and 7, respectively, are initialized to an inverter logic threshold voltage (VTH) at an intermediate voltage of a power voltage. Thus, the first to the third capacitors 2, 4 and 6, respectively, connected to each input terminal of the first to the third inverters 3, 5 and 7, are charged by a difference voltage of the input voltage Vin and the inverter logic threshold voltage VTH.

Next, for a feedback interval FEEDBACK, by a second control signal CS2 supplied as illustrated in FIG. 3, a fifth switch 5 for feedback is turned on, so that an output voltage Vout corresponding to the input voltage Vin is monitored in an output line. In other words, if a fed-back output voltage Vout is higher than the input voltage Vin when the fifth switch 11 is turned on, then the input voltage becomes higher than the threshold voltage VTH. As a result, the first to the third inverters 3, 5 and 7 drop the output voltage. If the fed-back output voltage Vout is lower than the input voltage Vin, then the input voltage Vin becomes lower than the threshold voltage VTH. As a result, the first to the third inverters 3, 5 and 7 raise the output voltage Vout. As described above, the output voltage Vout in the first to the third inverters 3, 5 and 7 is subject to an oscillation at an early stage of the feedback interval FEEDBACK, and ultimately converges to the input voltage Vin.

Because the analog buffer is organized with only the inverters, its configuration is simple compared to the related art analog buffer implemented using the amplifier OPAMP. However, in the analog buffer illustrated in FIG. 2, since the third inverter 7 in the output terminal should drive a data line DL with a large capacitance C, it has a drawback that its size should be large. Also, since the third inverter 7 in the output terminal should always maintain the threshold voltage VTH after the output voltage has been converged to the input voltage Vin, it has a drawback that its power consumption becomes large.

SUMMARY OF THE INVENTION

Accordingly, the present invention is directed to an analog buffer for use in a liquid crystal display device that substantially obviates one or more of the problems due to limitations and disadvantages of the related art.

It is an advantage of the present invention to provide an analog buffer and a liquid crystal display apparatus using the same and a driving method thereof capable of reducing power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an analog buffer according to the present invention includes: a comparator including an inverter connected in series to the input line; a feedback switch connected between the input line and the output line; and an output inverter, connected between the comparator and the output line, for pre-charging any one of driving voltages of a first driving voltage and a second driving voltage into the output line for a reset interval, and for cutting-off the first and the second driving voltages when the pre-charged voltage is fed back via the feedback switch to the input line so that it is converged to the input voltage for a feedback interval.

The comparator includes: a plurality of inverters connected in series between the input line and the output inverter; a capacitor connected in series to an input terminal of the inverter; and an initializing switch for initializing the inverter by connecting an input terminal and an output terminal of the inverter for the reset interval.

The analog buffer further includes an input switch for supplying the input voltage to the input line for the reset interval.

The output inverter includes: a first transistor and a second transistor connected between the comparator and the output line to configure an inverter; a third transistor connected between a supplying line of the first driving voltage and the first transistor, the third transistor being controlled by a controlling signal; and a fourth transistor connected between a supplying line of the second driving voltage and the second transistor, the fourth transistor being controlled by the controlling signal.

Each of the first and the third transistors includes a PMOS transistor, and each of the second and the fourth transistors includes a NMOS transistor.

The output inverter, for the reset interval, turns-on the first and the third transistors to pre-charge the first driving voltage into the output line when an input voltage of a first polarity is supplied to the input line; and wherein the output inverter, for the feedback interval, turns-on the second and the fourth transistors, so that a voltage on the output line is converged to the input voltage while discharging the second driving voltage.

The output inverter, for the reset interval, turns-on the second and the fourth transistors to pre-charge the second driving voltage into the output line when an input voltage of a second polarity is supplied to the input line; and wherein the output inverter, for the feedback interval, turns-on the second and the fourth transistors, so that that voltage on the output line is converged to the input voltage while charging the first driving voltage.

The analog buffer further includes a second capacitor connected between the feedback switch and the input line, wherein the output voltage is adjusted by a ratio of the capacitor and the second capacitor.

The analog buffer of claim further includes: N bit digital-analog converter including N-number of switches for selectively outputting any one of third and fourth driving voltages in response to N bit data, respectively, and a plurality of capacitors connected between the N-number of switches and the input line, wherein the N bit digital-analog converter divides a voltage between the third and the fourth driving voltages in accordance with the n bit data to supply the divided voltage to the input line.

A liquid crystal display apparatus according to the present invention includes: a data driver for driving data lines of a pixel matrix; a gate driver for driving gate lines of the pixel matrix; and a common voltage generator for supplying a common voltage, which is a reference voltage, to a common electrode of the pixel matrix, wherein at least one of the data driver, the gate driver and the common voltage generator includes the analog buffer.

The data driver inverts a polarity of a data signal in accordance with a polarity-controlling signal and then supplies the inverted data signal to the data line, and wherein the common voltage generator supplies an alternating common voltage to the common electrode.

In case that the common voltage generator supplies the common voltage of a positive polarity and the data driver supplies the data signal of a negative polarity, the analog buffer of the data driver makes the first driving voltage to be pre-charged into the data line for the reset interval and makes the pre-charged voltage to be discharged to the second driving voltage for the feedback interval, so that the pre-charged voltage is converged to the data signal of negative polarity.

The analog buffer of the common voltage generator, for the reset interval, if the common voltage having positive polarity is supplied thereto, makes the first driving voltage to be pre-charged into the common electrode, and makes the pre-charged voltage to be converged to the common voltage of positive polarity by raising the pre-charged voltage by the second driving voltage, for the feedback interval.

In case that the common voltage generator supplies the common voltage of negative polarity and the data driver supplies the data signal of positive polarity, the analog buffer of the data driver makes the second driving voltage to be pre-charged into the data line for the reset interval, and makes the pre-charged voltage to be converged to the data signal of positive polarity by raising the pre-charged voltage by the first driving voltage for the feedback interval.

The analog buffer of the common voltage generator pre-charges the second driving voltage into the common electrode, for the reset interval, if the common voltage having negative polarity is supplied thereto, and converged the pre-charged voltage to the data signal of negative polarity by discharging the pre-charged voltage by the first driving voltage for the feedback interval.

The data driver further includes a demultiplexer for time-dividing the data signal supplied via the analog buffer to sequentially supply the time divided data signal to a plurality of data lines.

A method of driving a liquid crystal display apparatus using the data driver and the common voltage generator having the analog buffer includes a period during which the common voltage generator supplies a common voltage of positive polarity to the common electrode and a period during which the common voltage generator supplies a common voltage of negative polarity to the common electrode, and wherein the analog buffer of the data driver pre-charges the first driving voltage for the reset interval into the data line if the data signal having negative polarity is supplied thereto and if the common voltage has positive polarity. The pre-charged voltage converges to the data signal of negative polarity while it is discharged to the second driving voltage, for the feedback interval, and wherein the analog buffer of the data driver, in case that the common voltage has negative polarity, makes the second driving voltage to be pre-charged into the data line, for the reset interval, if the data signal of positive polarity is supplied thereto, and makes the pre-charged to be converged to the data signal of positive polarity by raising the first driving voltage by the first driving voltage, for the feedback interval.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the embodiments of the present invention, examples of which are illustrated in the accompanying drawing.

Hereinafter, the illustrated embodiments of the present invention will be described in detail with reference to FIGS. 4 to 10.

Figure 1:
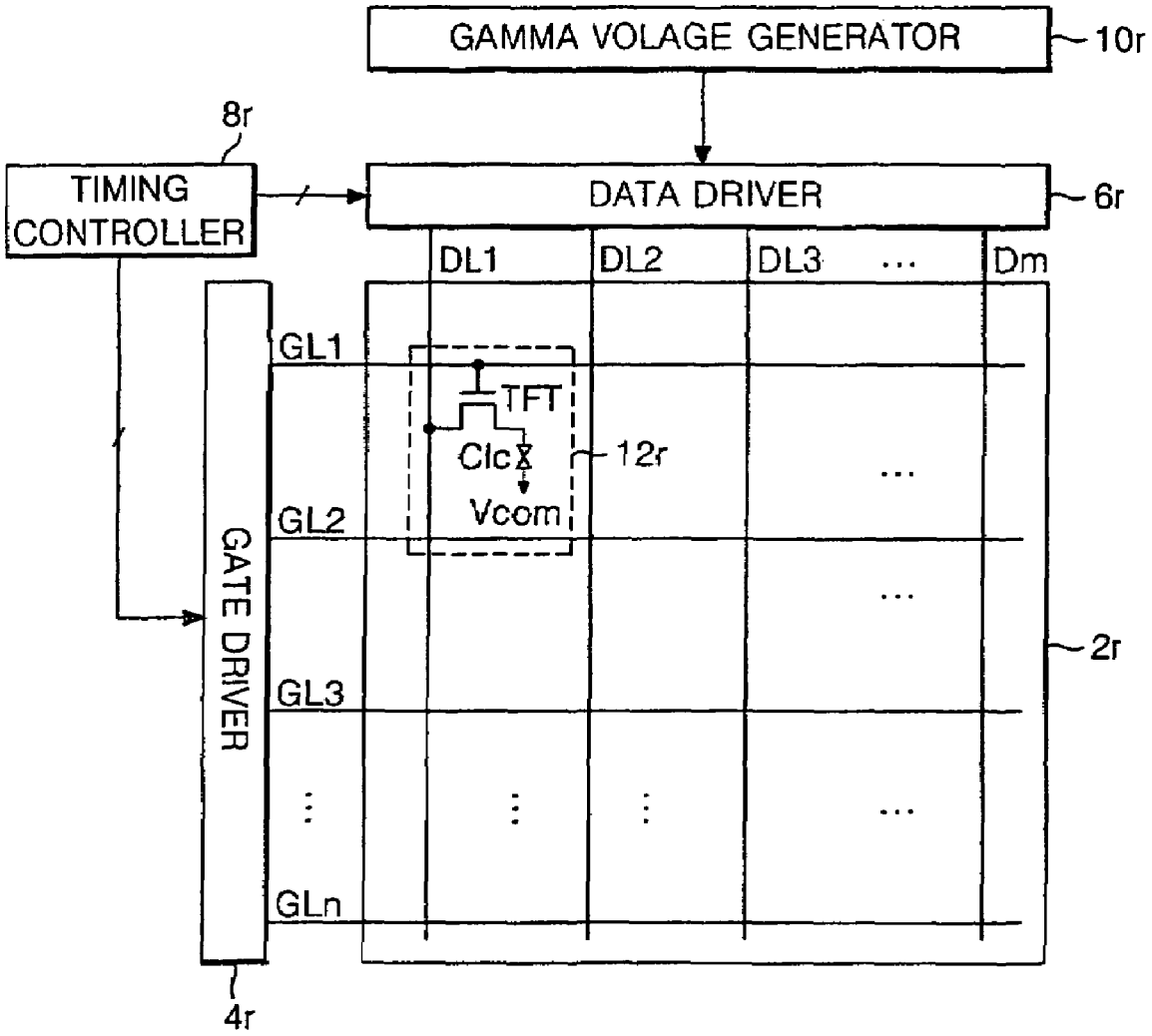
FIG. 1 RELATED ART
FIG. 1 is a schematic block diagram illustrating a related art liquid crystal display device.
Figure 2:
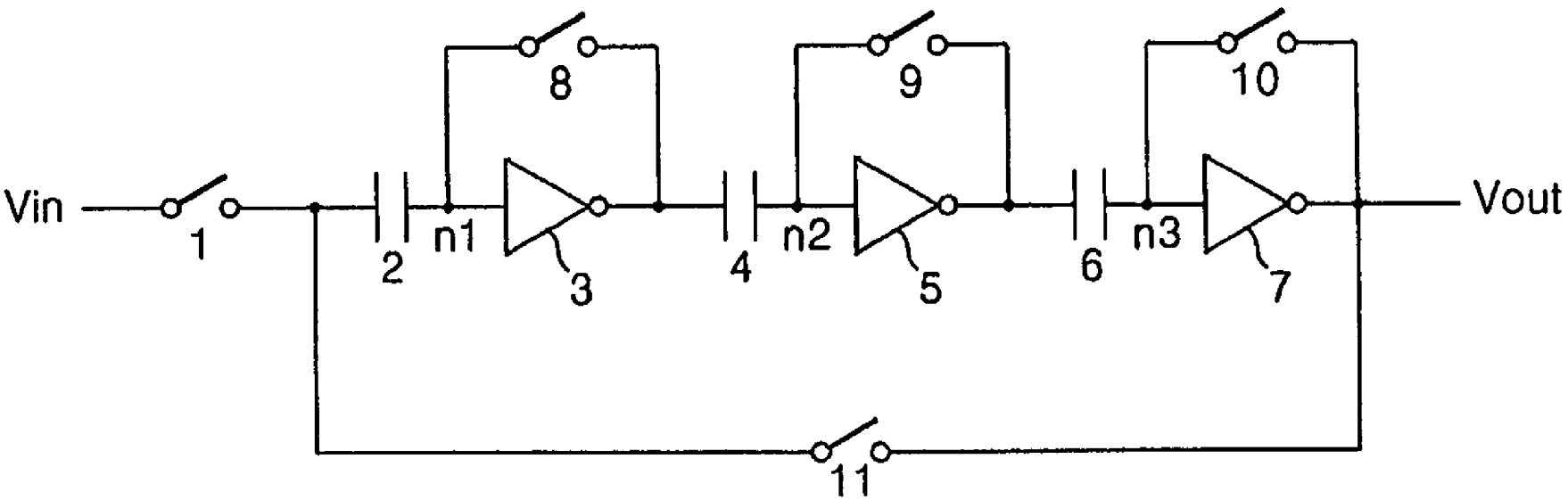
FIG.2 RELATED ART
FIG. 2 is a circuit diagram illustrating a related art analog buffer.
Figure 3:
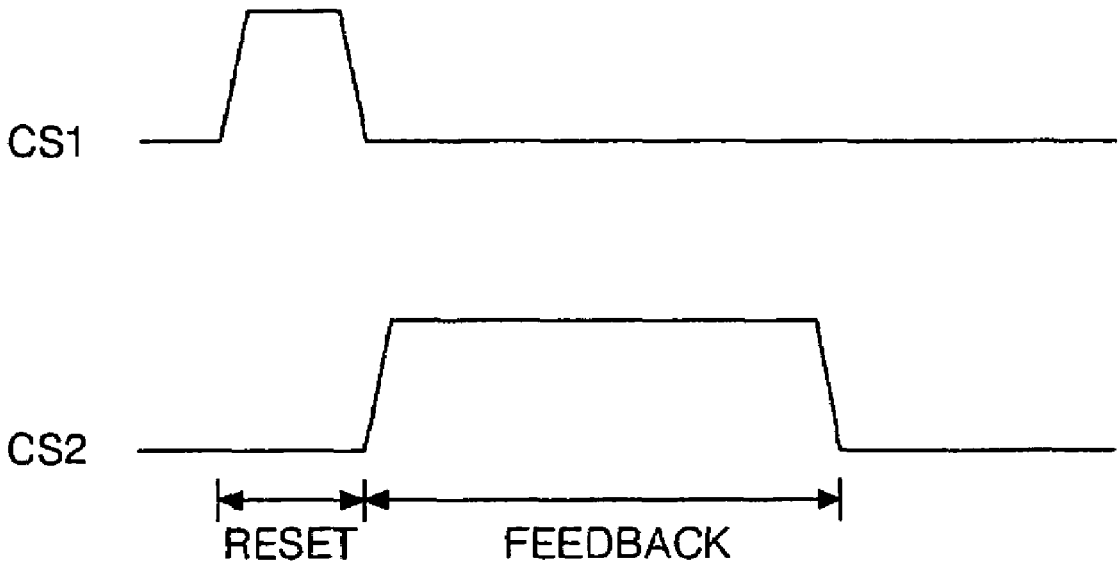
FIG. 3 RELATED ART
FIG. 3 is a driving waveform diagram of the analog buffer illustrated in FIG. 2.
Figure 4:
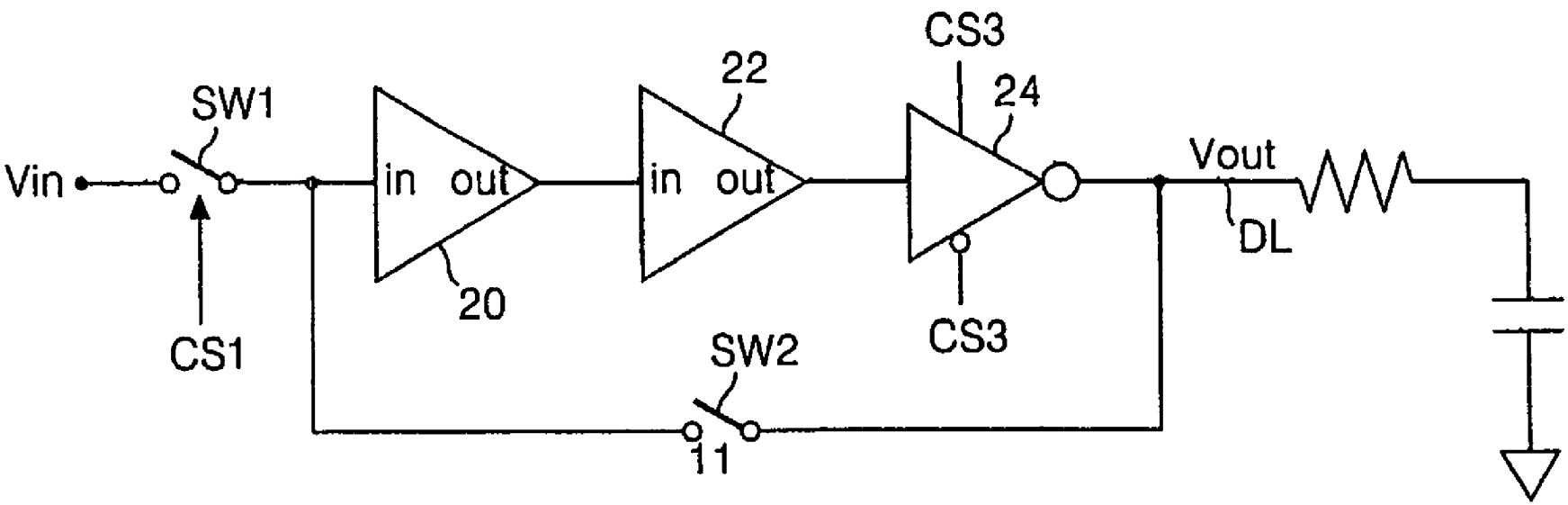
FIG. 4 is a circuit diagram of an analog buffer according to an embodiment of the present invention.

FIG. 4 is a schematic circuit diagram of an analog buffer according to an embodiment of the present invention.

Referring to FIG. 4, the analog buffer of the data driver includes: a first comparator 20, a second comparator 22 and an output inverter 24 which are connected in series between an input line and a data line DL; an input switch SW1 connected between the input line and the first comparator 20; and a feedback switch SW2 connected between the input line and the data line DL.

Figure 5:
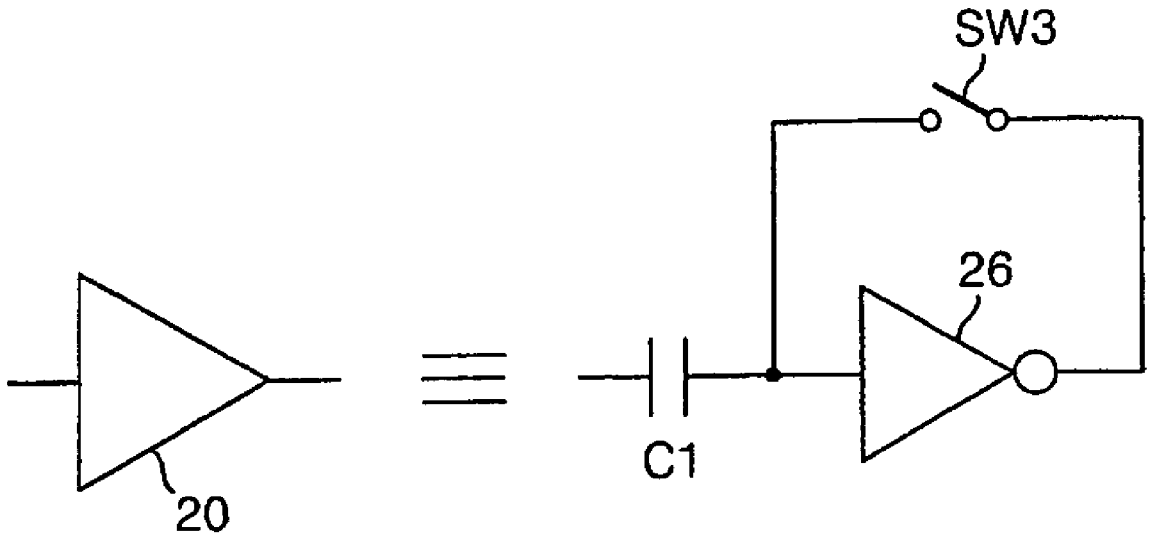
FIG. 5 is an equivalent circuit diagram of a comparator illustrated in FIG. 4.
Figure 6:
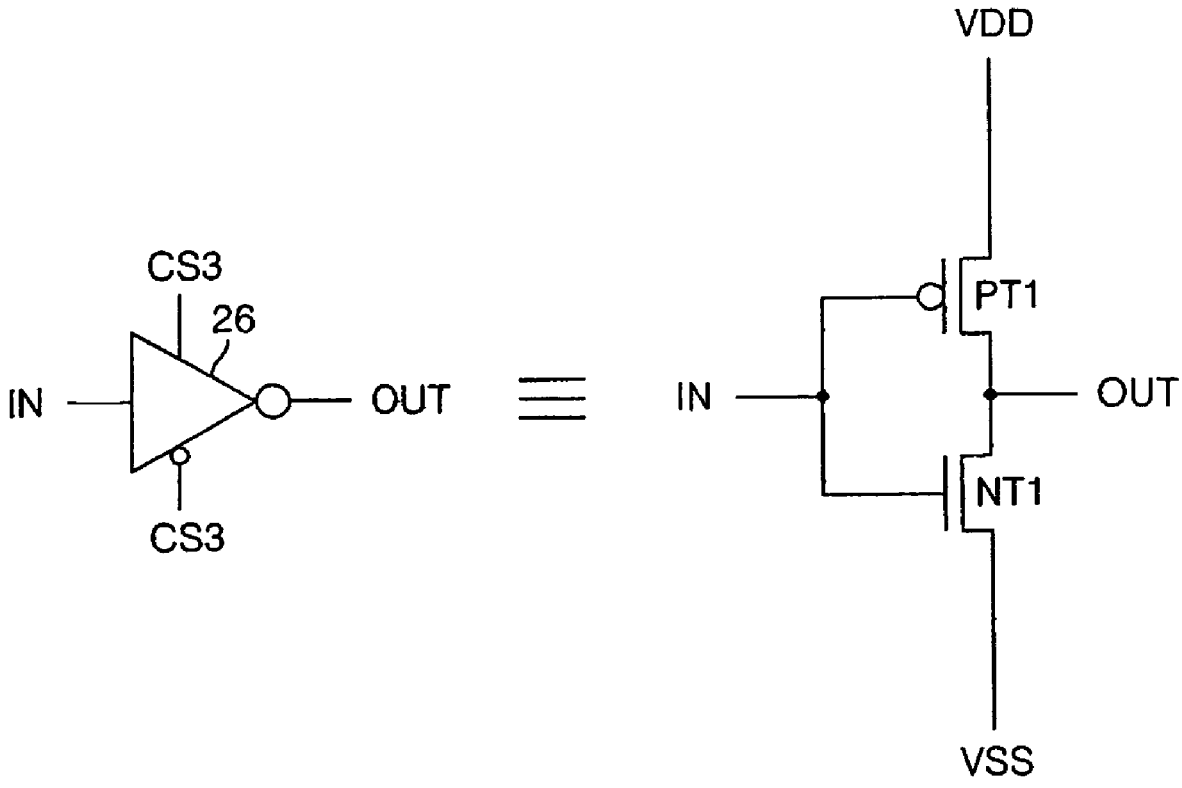
FIG. 6 is a detailed circuit diagram of the analog buffer illustrated in FIG. 5.
Figure 7:
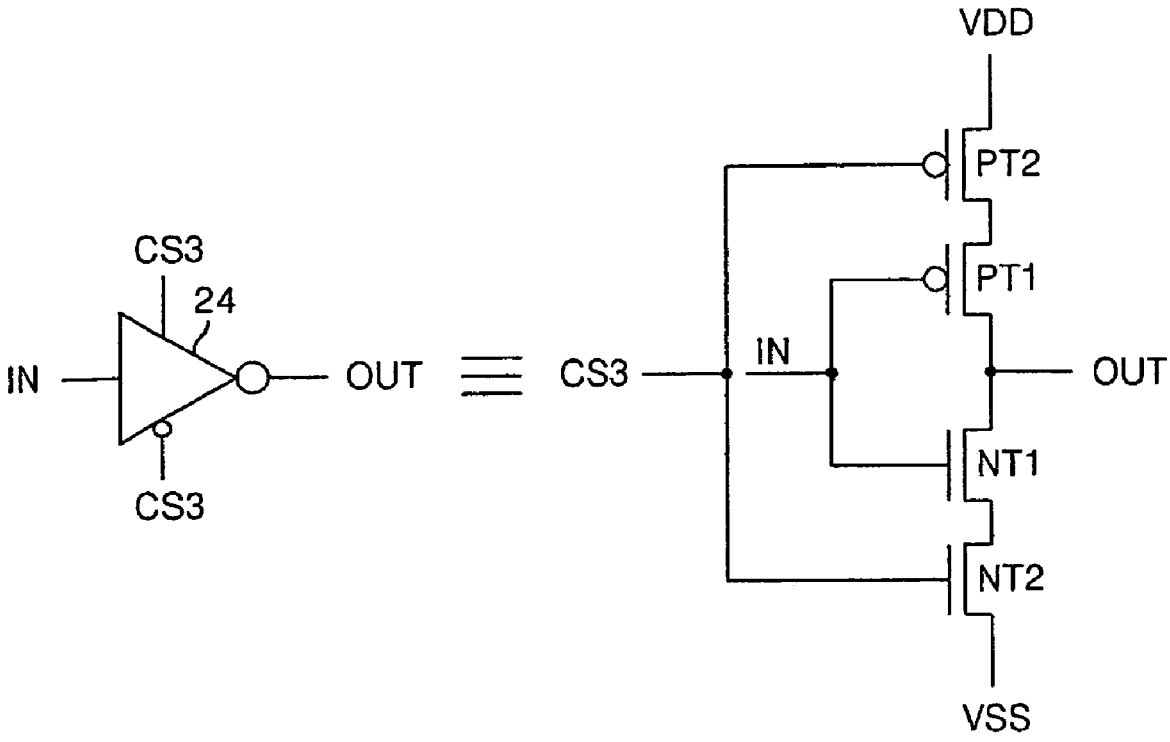
FIG. 7 is a detailed circuit diagram of an output inverter illustrated in FIG. 4.

Each of the first and the second comparators 20 and 22 is composed with an inverter. More specifically, each of the first and the second comparators 20 and 22 includes an inverter 26, a capacitor C1 connected to an input terminal of the inverter 26, and an initializing switch SW3 connected between the input terminal and the output terminal of the inverter 26, as illustrated in FIG. 5. The initializing switch SW3 is driven along with the input switch SW1 by the first control signal CS1. The inverter 26 includes: a PMOS transistor PT1 connected between a supplying line of a high potential voltage VDD and the output terminal and controlled by the input terminal; and a NMOS transistor NT1 connected between a supplying line of a low potential voltage VSS and the output terminal and controlled by the input terminal, as illustrated in FIG. 6.

The output inverter 24 is switched by a third control signal CS3. More particularly, the output inverter 24 includes: a first PMOS transistor PT1 and a first NMOS transistor NT1 that constitute an inverter between an input terminal IN and an output terminal OUT; a second PMOS transistor PT2 switching the high potential voltage VDD to the first PMOS transistor PT1 in response to the third control signal CS3; a second NMOS transistor NT2 switching the low potential voltage VSS to the first NMOS transistor NT1 in response to the third control signal CS3.

The feedback switch SW2 is controlled by the second control signal CS2 having a polarity opposite to that of the first control signal CS1.

A method of driving the analog buffer having the configuration set forth above will be described with reference to a driving waveform illustrated in FIG. 8.

Figure 8:
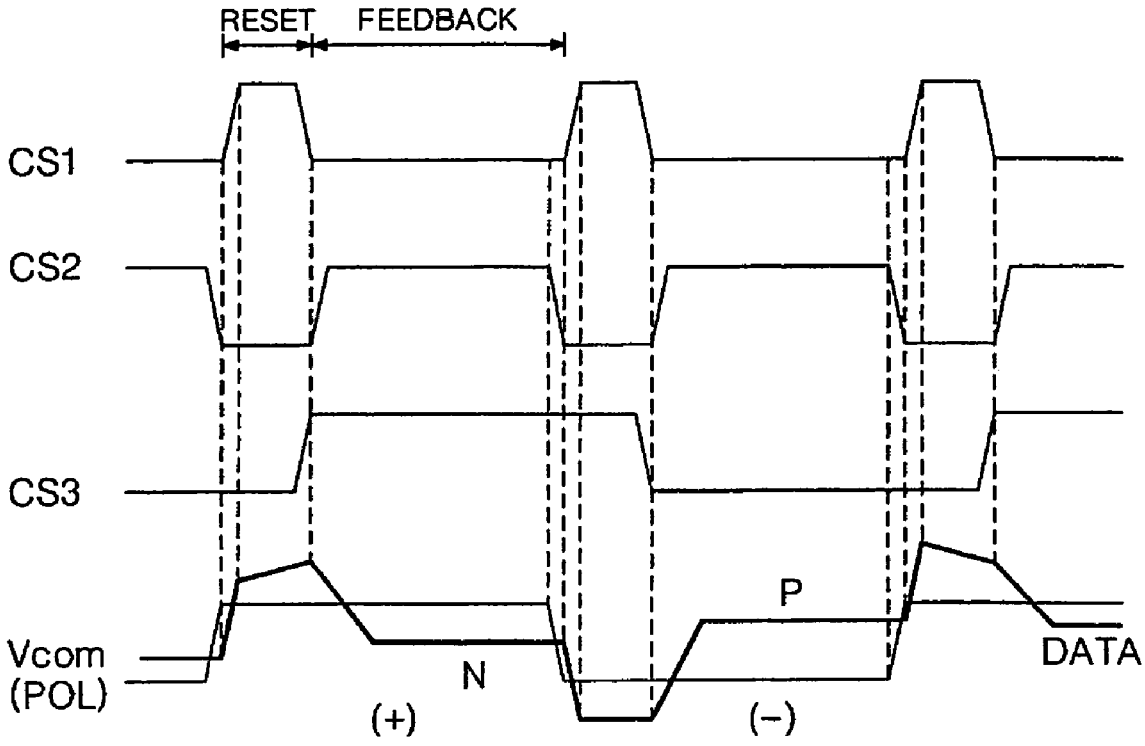
FIG. 8 is a driving waveform diagram of the analog buffer illustrated in FIG. 4.

Referring to FIG. 8, an alternating common voltage Vcom driven for a line inversion is inverted by one horizontal line unit. A polarity of a polarity-controlling signal (POL) that determines a polarity of a data signal is inverted to a polarity opposite to that of the common voltage Vcom. Accordingly, if the common voltage Vcom has a positive polarity, then a data signal DATA having a negative polarity (with respect to the common voltage Vcom) is supplied to the data line DL. If the common voltage Vcom has a negative polarity, a data signal DATA having a positive polarity (with respect to the common voltage Vcom) is supplied to the data line DL. As a result, it is possible to reduce a voltage range of the data signal DATA by alternating it with respect to the common voltage Vcom, resulting in reduced power consumption.

More particularly, in a case that the data signal of negative polarity is supplied, for a reset interval RESET, the input switch SW1 and the initializing switch SW3 are turned on in response to the first control signal CS1 of a logic high state. Accordingly, the input terminal and the output terminal of the inverter 26, configuring the first and the second comparators 20 and 22, is initialized to the level of the threshold voltage VTH, so that the capacitor C1 is charged by a difference voltage between the input voltage Vin and the threshold voltage VTH. At this time, the high potential voltage VDD is pre-charged into the data line DL via the second PMOS transistor PT2 of the output inverter 24 turned on by the third control signal CS3 of a logic low state and the first PMOS transistor PT1 turned on by the input terminal voltage.

Thereafter, for a feedback interval FEEDBACK, the input switch SW1 and the initializing switch SW3 are turned off by the first control signal CS1 of a logic low state and the feedback switch SW2 is turned on by the second control signal CS2 of a logic high state, so that the pre-charged voltage VDD into the data line DL is converged to the data signal of negative polarity. More particularly, the pre-charged voltage VDD into the data line DL is lowered with discharging toward the low potential voltage VSS via the second NMOS transistor NT2 of the output inverter 24 turned on by the third control signal CS3 of a logic high state and the first NMOS transistor NT1 turned on by the input terminal voltage. Subsequently, if the voltage Vout of the data line DL becomes same as the input data signal Vin of positive polarity or becomes lower than the input data signal Vin of positive polarity, then the input terminal voltage of the output inverter 24 is lowered by the first and the second comparators 20 and 22 thereby turning-off the first NMOS transistor NT1 so that the charge into the data line DL is completed. As a result, if the data signal of negative polarity is charged into the data line DL, then current path in the output inverter 24 is cut-off. Thus, it is possible to reduce power consumption.

On the contrary, if the data signal of positive polarity is supplied to the data line DL, then the output inverter 24 does an operation opposite to that described above.

More particularly, if the data signal of positive polarity is supplied, then the low potential voltage VSS is pre-charged into the data line DL via the second NMOS transistor NT2 of the output inverter 24 turned-on by the third control signal CS3 of the logic high state and the first NMOS transistor NT1 turned on by the input terminal voltage.

Next, for a feedback interval FEEDBACK, i.e., a charge period of data, the feedback switch SW2 is turned on by the second control signal CS2 having a logic high state, so that the pre-charged voltage VSS into the data line DL is converged to the data signal Vin of positive polarity. More particularly, the pre-charged voltage VSS rises by the high potential voltage VDD supplied via the second PMOS transistor PT2 of the output inverter 24 turned on by the third control signal CS3 of a logic low state and the first PMOS transistor PT1 turned on by the input terminal voltage. Accordingly, if the output voltage Vout of the data line DL becomes same as the input data signal Vin of positive polarity or becomes higher than the input data signal Vin of positive polarity, then the input terminal voltage of the output inverter 24 rises by the first and the second comparators 20 and 22, thereby turning-off the first PMOS transistor PT1, so that the charge of the data line is completed. As a result, if the data signal of positive polarity is charged in the data line DL, then current path in the output inverter 24 is cut-off. Thus, it is possible to reduce power consumption.

As described above, according to the present invention of the output inverter 24 of the analog buffer, since the voltage Vout provided to the data line DL is not same as the input data signal Vin, current flows only if the voltage is charged and discharge. Also, if the charge into the data line DL is completed, then current does not flow. As a result, it is possible to reduce power consumption. Further, according to the present invention of the output inverter 24 of the analog buffer, since the PMOS transistors PT1 and PT2, and the NMOS transistors NT1 and NT2 do not turned on simultaneously, it is possible to prevent an oscillation with a repetitive rising and falling during which the output voltage Vout is converged to the input voltage Vin. In addition, the analog buffer according to the present invention minimizes a size of a transistor included in the inverter 26 except for the output inverter 24. Thus, it is possible to reduce power consumption.

Figure 9:
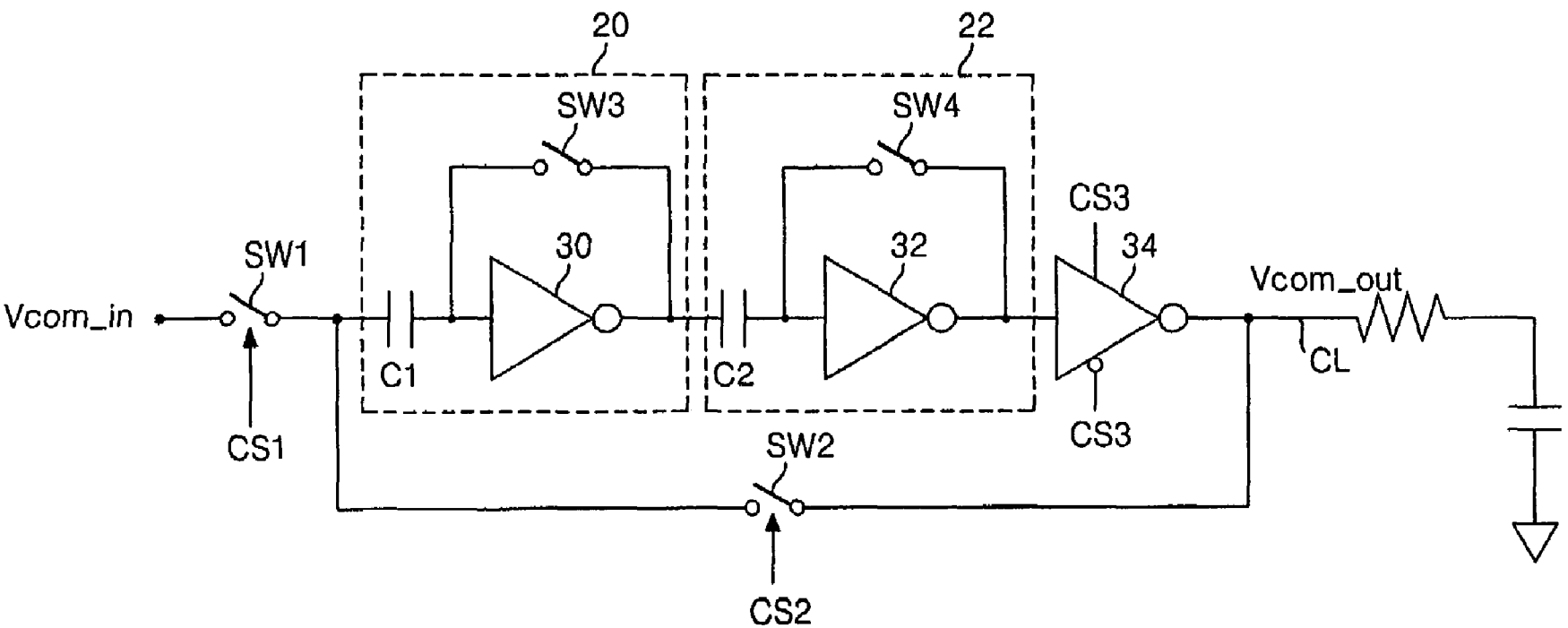
FIG. 9 is a circuit diagram of the analog buffer in a common voltage generator according to another embodiment of the present invention.
Figure 10:
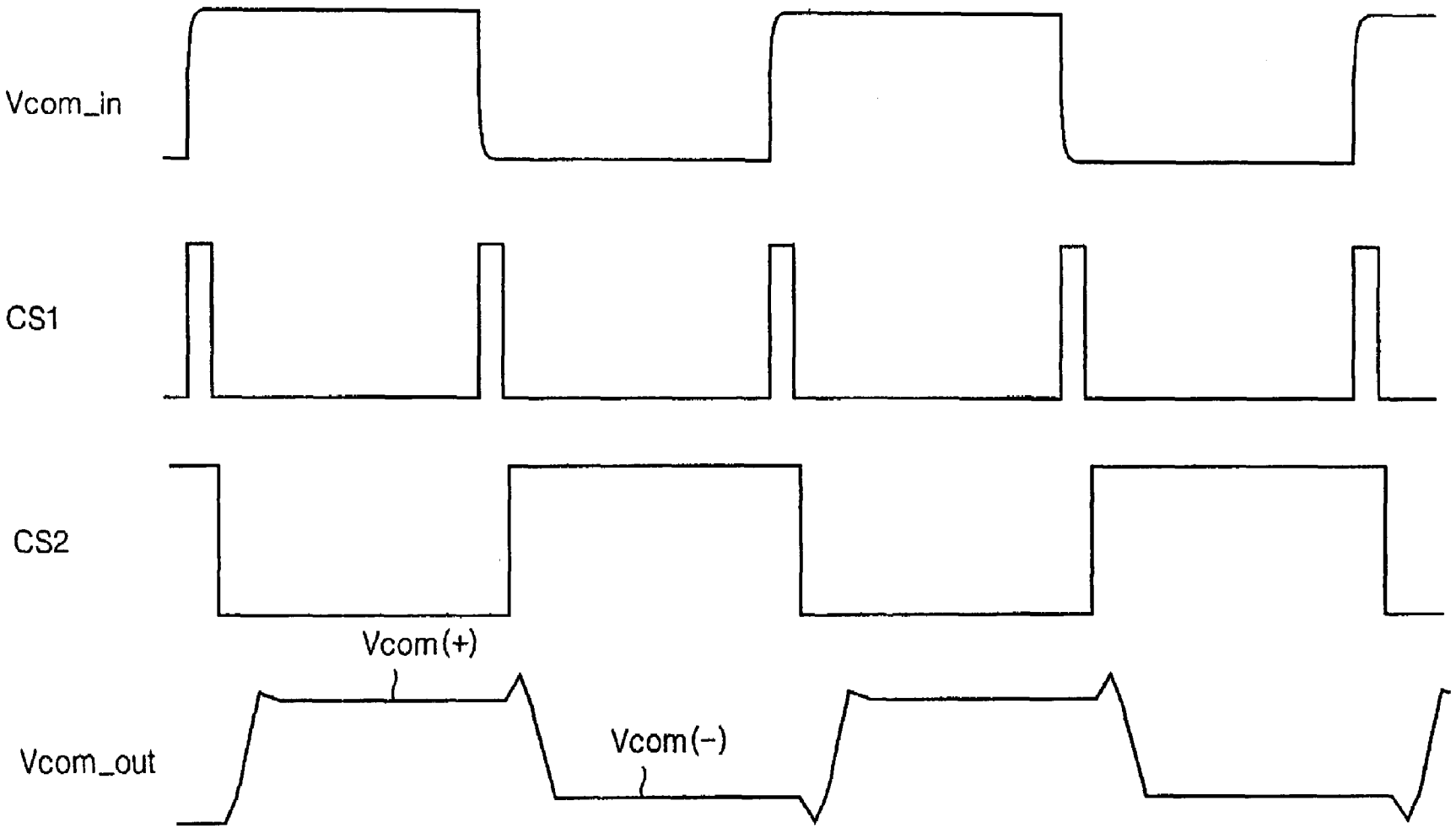
FIG. 10 is a driving waveform diagram of the analog buffer illustrated in FIG. 9.

FIG. 9 illustrates an analog buffer used in a common voltage generator according to another embodiment of the present invention, and FIG. 10 illustrates a driving waveform diagram of the analog buffer illustrated in FIG. 9.

The analog buffer of the common voltage generator illustrated in FIG. 9 has a configuration identical to that of the data driver illustrated in FIG. 4. Thus, a detailed explanation of the analog buffer illustrated in FIG. 9 will be omitted for the sake of simplicity. However, the common voltage Vcom inverted to a polarity opposite to that of the data signal for driving the line inversion as described above is supplied to the input line and the output line. To this end, the third control signal CS3 controlling the output inverter 24 is inverted to a polarity opposite to that of the third control signal CS3 illustrated in FIG. 8.

Firstly, in a cast that a common voltage Vcom_in of positive polarity is supplied, for a reset interval RESET, a common electrode CL is initialized to the level of the low potential voltage VSS, via the second NMOS transistor NT2 of the output inverter 24 turned on by the third control signal CS3 of the logic high stage and the first NMOS transistor NT1 turned on by the input terminal voltage. Thereafter, for a feedback interval FEEDBACK, an output voltage Vcom_out of the common electrode CL rises by a high potential voltage VDD supplied through the second PMOS transistor PT2 of the output inverter 24 turned on by the third control signal CS3 of the logic low state and the first PMOS transistor PT1 turned on by the input terminal voltage, and ultimately the output voltage Vcom_out of the common electrode CL is converged to the input common voltage Vcom_in of positive polarity. Subsequently, if the voltage Vcom_out of the common electrode CL becomes same as the input common voltage Vcom_in of positive polarity or becomes higher than the input common voltage Vcom_in of positive polarity, then the input terminal voltage of the output inverter 24 rises, thereby turning-off the first PMOS transistor PT1, so that the charge of the common electrode CL is finished. Then, the current path in the output inverter 24 is cut-off.

On the contrary, in a case that a common voltage Vcom_in of a negative polarity is supplied, for the reset interval RESET, the common electrode CL is initialized to the level of the high potential voltage VDD, via the second PMOS transistor PT2 of the output inverter 24 turned on by the third control signal CS3 of the logic low stage and the first PMOS transistor PT1 turned on by the input terminal voltage. Thereafter, for a feedback interval FEEDBACK, the output voltage Vcom_out of the common electrode CL falls by a low potential voltage VSS supplied through the second NMOS transistor NT2 of the output inverter 24 turned on by the third control signal CS3 of the logic high state and the first NMOS transistor NT1 turned on by the input terminal voltage, and ultimately the output voltage Vcom_out of the common electrode CL is converged to the input common voltage Vcom_in of negative polarity. Subsequently, if the voltage Vcom_out of the common electrode CL becomes same as the input common voltage Vcom_in of negative polarity or becomes lower than the input common voltage Vcom_in of positive polarity, then the input terminal voltage of the output inverter 24 falls, thereby turning-off the first NMOS transistor NT1, so that the charge of the common electrode CL is completed. Then, the current path in the output inverter 24 is cut-off.

As described above, according to the output inverter 24 of the analog buffer of the invention, since the voltage Vcom_out provided to the common electrode CL is not same as the input common voltage Vcom_in, current flows only if the voltage is charged and discharge. Also, if the charge of the common electrode CL is completed, then current does not flow. As a result, it is possible to reduce power consumption. Further, according to the output inverter 24 of the analog buffer of the present invention, since the PMOS transistors PT1 and PT2, and the NMOS transistors NT1 and NT2 do not simultaneously turned on, it is possible to prevent an oscillation with a repetitive rising and falling during which the output voltage Vcom_out is converged to the input voltage Vcom_in.

Figure 11:
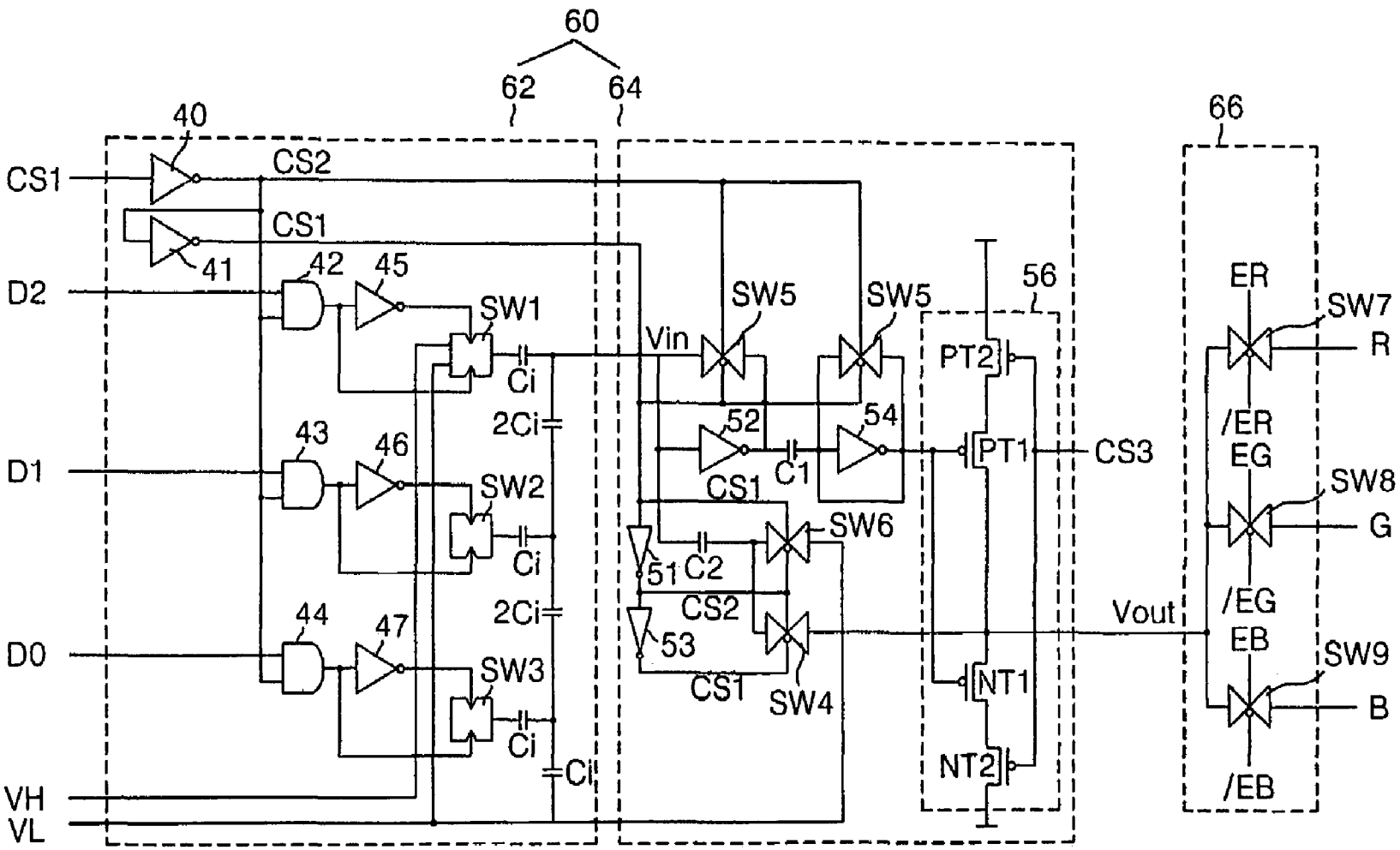
FIG. 11 is a circuit diagram of an analog buffer included in a data driver according to the other embodiment of present invention.

FIG. 11 is a detailed circuit diagram illustrating an analog buffer of a data driver according to further another embodiment of present invention.

The analog buffer 60 illustrated in FIG. 11 includes a least significant bit digital-to-analog converter (DAC) 62 and an output buffer 64. The analog buffer 60 further includes a demultiplexer to time-divide an output voltage Vout of the analog buffer 60 to supply the time-divided output voltage Vout to a plurality of data lines.

The least significant bit DAC 62 converts least significant three bits D0, D1 and D3 among data supplied to a data driver into a corresponding analog signal. Data of most significant bits are converted into an analog signal by a most significant bit DAC part. Accordingly, the least significant bit DAC 62 converts the three least significant bits into analog signals by using an upper limit voltage VH and a lowest limit voltage VL including voltages subdivided by the least significant bits LSBs among a plurality of gamma voltages having a variety of levels selected by the most significant bit DAC part.

To this end, the least significant bit DAC 62 includes first to third switches SW1, SW2 and SW3 that selectively output voltages between the upper limit voltage VH and the lowest limit voltage VL in accordance with the least significant three bits D1, D2, D3, and a plurality of capacitors Ci and 2Ci connected in series or in parallel between the first to the third switches SW1, SW2 and SW3, and an input terminal of the output buffer 64. The first to the third switches SW1, SW2 and SW3, and capacitors Ci and 2Ci function to divide a voltage between the upper limit voltage VH and the lowest limit voltage VL into eight voltage levels in accordance with the three least significant data bits D0, D1 and D2 to supply the divided voltage to the input voltage Vin.

The least significant bit DAC 62 further includes first to third NAND gates 42, 43 and 44 connected between input lines of the least significant three bits data D0, D1 and D2, and the first to the third switches SW1, SW2 and SW3, respectively. The first to the third NAND gates 42, 43 and 44 function to combine a first control signal CS1 supplied via first and second inverters 40 and 41, and the three least significant data bits D0, D1 and D2 to supply control signals for the first to the third switches SW1, SW2 and SW3, respectively. In other words, the first to the third NAND gates 42, 43 and 44 control the first to the third switches SW1, SW2 and SW3 so as to output the upper limit voltage VH and the lowest limit voltage VL in accordance with the three least significant bits D0, D1 and D2, respectively, for the reset interval RESET during which the first control signal CS1 is in a logic high. At this time, output signals of the first to the third NAND gates 42, 43 and 44 are used for control signals that control p-type transistors of the first to the third switches SW1, SW2 and SW3, respectively. Also, the output signals of the first to the first third NAND gates 42, 43 and 44 via the third to fifth inverters 45, 46 and 47 are used for the control signals that control N-type transistors of the first to the third switches SW1, SW2 and SW3, respectively.

The output buffer 64 includes: sixth to eighth inverters 52, 54 and 56 connected in series between the input terminal Vin and the output terminal Vout; a switch SW4 connected between the input terminal and the output terminal to feed back the output voltage Vout; a fifth switch SW5 to initialize each of the sixth and the seventh inverters 52 and 54; a first capacitor C1 connected an input terminal of the seventh inverter 54. The output buffer 64 identically operates to the buffer illustrated in FIG. 4. The output buffer 64 further includes a sixth switch SW6 connected between a second capacitor C2 and the lowest limit voltage VL of a supplying line, and ninth and tenth inverters 51 and 53 for supplying the first and the second control signals CS1 and CS2 to the fourth switch SW4 to make the fourth switch SW4 be operated contrary to that of the sixth switch SW6. The sixth switch SW6 is turned on for the reset interval RESET to settle one node of the second capacitor C2 to the level of the lowest limit voltage VL. And then the input voltage Vin is determined with a ratio of the capacitors Ci and 2Ci included in the least significant bit DAC and the second capacitor.

The demultiplexer 66 includes seventh to ninth switches SW7, SW8 and SW9 for selectively supplying the output voltage Vout to R, G, and B data lines. The seventh switch SW7, in response to an R enable signal RE, supplies the output voltage of the output buffer 64 to the R data line. The eighth switch SW8, in response to a G enable signal GE, and supplies the output voltage Vout to the G data line. The ninth switch SW9, in response to a B enable signal BE, and supplies the output voltage Vout of the output buffer 64 to the B data line.

A method of driving the analog buffer 60 and the demutiplexer 66 having the configuration as set forth above will be described with reference to the driving waveform illustrated in FIG. 12.

Figure 12:
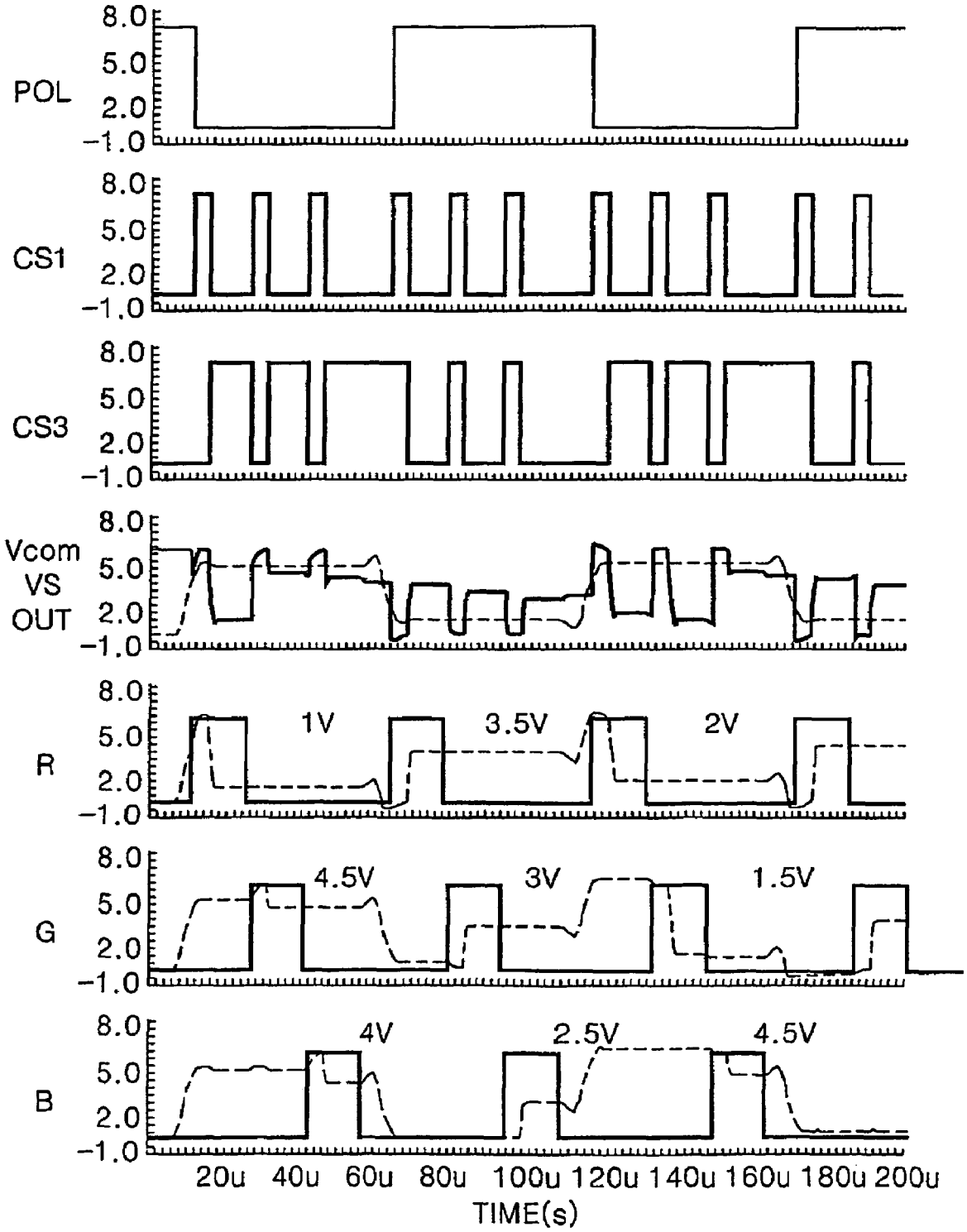
FIG. 12 is a driving waveform diagram of the analog buffer illustrated in FIG. 11.

Referring to FIG. 12, a polarity-controlling signal POL determining a polarity of a data signal is inverted for each horizontal period. The first and the third control signals CS1 and CS3, determining a reset interval and a feedback interval for the analog buffer 60, include the number of three times of the reset interval and the feedback interval so as to sequentially output the R, G, B data signal during a one frame period. The third control signal CS3 is alternately inverted for each one frame, i.e., for each edge of the polarity-controlling signal POL, so as to have a polarity opposite that of the first control signal CS1. However, the third control signal CS3 maintains its previous polarity to pre-charge the data signal from a point of time when the polarity of the polarity-controlling signal POL is inverted to a first reset interval.

More particularly, when a common voltage Vcom has a positive polarity in a reset interval, a data signal of a negative polarity is supplied by the first control signal CS1 of a logic high state from the least significant bit DAC 62 to the input terminal of the output buffer 64. At this time, the output voltage Vout of the analog buffer 60 is initialized to the level of the high potential voltage VDD by the third control signal CS3 having a logic low state. The output voltage Vout is charged by the demultiplexer 66 into any one of R, G and B data lines. Since polarities of the data line and the common electrode are identical to each other, it is possible to achieve efficient power consumption. Thereafter, for a feedback interval, the NMOS transistors NT1 and NT2 of the output inverter 56 are turned on by the third control signal CS3 of the logic high state, so that the output voltage Vout is converged to the input voltage Vin, i.e., a data signal of negative polarity. At this time, since the PMOS transistors PT1 and PT2 of the output inverter 56 are turned off, the current path is cut-off. As a result, power consumption becomes very low. The output voltage Vout is charged by the demultiplexer 66 into any one of R, G and B data lines. The analog buffer 60 and the demultiplexer 66 repeat the operation described above three times to sequentially charge the R, G and B data signals of negative polarity into their corresponding lines.

In a case that the common voltage has a negative polarity, for the reset interval, a data signal of a positive polarity is supplied by the first control signal CS1 of the logic high state from the least significant bit DAC 62 to the input terminal of the output buffer 64. At this time, the output voltage Vout of the analog buffer 60 is initialize to the level of the low potential voltage VSS by the third control signal CS3 of a logic high state. The output voltage Vout is charged by the demultiplexer 66 into any one of R, G and B data lines. Since polarities of the data line and the common electrode are identical to each other, it is efficient from power consumption. Thereafter, for the feedback interval, the PMOS transistors PT1 and PT2 of the output inverter 56 are turned on by the third control signal CS3 of the high state, so that the output voltage Vout is converged to the input voltage Vin, i.e. e., a data signal of positive polarity. At this time, since the NMOS transistors NT1 and NT2 of the output inverter 56 are turned off, the current path is cut-off. As a result, power consumption becomes very low. The output voltage Vout is charged by the demultiplexer 66 into any one of R, G and B data lines. The analog buffer 60 and the demultiplexer 66 repeat the above described operation three times to sequentially charge the R, G and B data signals of positive polarity into their corresponding lines.

As described above, according to the present invention of the output inverter of the analog buffer, since the output voltage is not same as the input voltage, current of the output inverter flows only when charging and discharging. Further, according to the present invention of the output inverter of the analog buffer, since the PMOS transistor and the NMOS transistor do not simultaneously turned on, a through current does not generate. As a result, power consumption is very small and an unstable phenomenon of the circuit such as an oscillation with a repetitive rising and falling is devoided.

Further, according to a liquid crystal display apparatus using the analog according to the present invention and a driving method thereof, the high potential voltage VDD is pre-charged into the data line in case that the common voltage has a positive polarity, and the low potential voltage VSS is pre-charged in case that the common voltage has a negative polarity, so that the polarities of the data line and the common electrode are identical to each other, which results in an efficient power consumption.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents

What is claimed is:

1. A liquid crystal display apparatus, comprising:

a data driver for driving data lines of a pixel matrix;

a gate driver for driving gate lines of the pixel matrix; and a common voltage generator for supplying a common voltage, which is a reference voltage, to a common electrode of the pixel matrix, wherein each one of the data driver and the common voltage generator includes an analog buffer wherein the analog buffer includes:

a comparator having an inverter connected in series to the input line;

a feedback switch connected between the input line and the output line; and an output inverter, connected between the comparator and the output line, for pre-charging any one of a first driving voltage and a second driving voltage into the output line in accordance with an output voltage of the comparator and a controlling signal for a reset interval and for converging the pre-charged voltage to a voltage of the input line for a feedback interval, wherein the first and second driving voltages are generated from a voltage source, the first driving voltage is higher than the voltage of the input line, and the second driving voltage is lower than the voltage of the input line, wherein the output inverter includes:

a first transistor and a second transistor connected between the comparator and the output line to configure an inverter;

a third transistor connected between a supplying line of the first driving voltage and the first transistor, the third transistor being controlled by the controlling signal; and a fourth transistor connected between a supplying line of the second driving voltage and the second transistor, the fourth transistor being controlled by the controlling signal, wherein when the pre-charged voltage is converged to the voltage of the input line, the first to fourth transistors are turned off to cut-off current path of the output inverter, wherein the data driver inverts a polarity of a data signal in accordance with a polarity of the controlling signal and then supplies the inverted data signal to the data line, wherein the common voltage generator supplies an alternating common voltage to the common electrode, and wherein, when the common voltage generator supplies the common voltage of a positive polarity and the data driver supplies the data signal of a negative polarity, the analog buffer of the data driver makes the first driving voltage to be pre-charged into the data line for the reset interval and makes the pre-charged voltage to be discharged to the second driving voltage for the feedback interval, so that the pre-charged voltage is converged to the data signal of negative polarity.

2. The liquid crystal display apparatus of claim 1, wherein the analog buffer of the common voltage generator, for the reset interval, if the common voltage having positive polarity is supplied thereto, makes the first driving voltage to be pre-charged into the common electrode, and makes the pre-charged voltage to be converged to the common voltage of positive polarity by raising the pre-charged voltage by the second driving voltage, for the feedback interval.

3. The liquid crystal display apparatus of claim 1, wherein, in case that the common voltage generator supplies the common voltage of negative polarity and the data driver supplies the data signal of positive polarity, the analog buffer of the data driver makes the second driving voltage to be pre-charged into the data line for the reset interval, and makes the pre-charged voltage to be converged to the data signal of positive polarity by raising the pre-charged voltage by the first driving voltage for the feedback interval.

4. The liquid crystal display apparatus of claim 3, wherein the analog buffer of the common voltage generator makes the second driving voltage to be pre-charged into the common electrode, for the reset interval, if the common voltage having negative polarity is supplied thereto, and makes the pre-charged voltage to be converged to the data signal of negative polarity by discharging the pre-charged voltage by the first driving voltage, for the feedback interval.

5. The liquid crystal display apparatus of claim 1, wherein the data driver further includes a demultiplexer for time-dividing the data signal supplied via the analog buffer to sequentially supply the time divided data signal to a plurality of data lines.

6. A method of driving a liquid crystal display apparatus using a data driver and a common voltage generator, at least one of the data driver and the common voltage generator having an analog buffer, the method comprising:

a common voltage generator supplying a common voltage of positive polarity to the common electrode in a first period;

the common voltage generator supplying a common voltage of negative polarity to the common electrode in a second period, wherein when the common voltage has positive polarity and the data signal having negative polarity and input from an input line is supplied to the data line, the analog buffer of the data driver including a comparator and an output inverter pre-charges a first driving voltage into the data line in accordance with an output voltage of the comparator and a controlling signal for the reset interval, and converges the pre-charged voltage to the data signal of negative polarity while discharging the pre-charged voltage to a second driving voltage for the feedback interval, and;

wherein when the common voltage has negative polarity and the data signal having positive polarity and input from an input line is supplied to the data line, the analog buffer pre-charges the second driving voltage into the data line in accordance with an output voltage of the comparator and the controlling signal for the reset interval, and converges the pre-charged voltage to the data signal of positive polarity while raising the first driving voltage by the first driving voltage for the feedback interval, wherein the first and second driving voltages are generated from a voltage source, the first driving voltage is higher than the data signal of the input line, and the second driving voltage is lower than the voltage of the input line, wherein the data driver inverts a polarity of the data signal in accordance with a polarity of the controlling signal and then supplies the inverted data signal to the data line, and wherein the common voltage generator supplies an alternating common voltage to the common electrode.

7. The method of claim 6, wherein the analog buffer of the common voltage generator makes the first driving voltage to be pre-charged into the common electrode, for the reset interval, if the common voltage having positive polarity is supplied thereto, and makes the pre-charged voltage to be converged to the common voltage of positive polarity by raising the pre-charged voltage by the second driving voltage, for the feedback interval.

8. The liquid crystal display apparatus of claim 6, wherein the analog buffer of the common voltage generator makes the second driving voltage to be pre-charged into the common electrode, for the reset interval, if the common voltage having negative polarity is supplied thereto, and makes the pre-charged voltage to be converged to the data signal having negative polarity by discharging the pre-charged voltage by the first driving voltage, for the feedback interval.

* * * * *